US008651200B2

(12) United States Patent
Krohn et al.

(10) Patent No.: US 8,651,200 B2
(45) Date of Patent: Feb. 18, 2014

(54) TOOL GUIDE DEVICE FOR A DRILL FLOOR

(75) Inventors: Helge Krohn, Sandnes (NO); Mads Grinrød, Stavanger (NO); Odd B. Skjaerseth, Stavanger (NO); Ove Kalvatn, Stavanger (NO); Jarle Veshovde, Sola (NO)

(73) Assignee: West Drilling Products AS (NO)

( * ) Notice: Subject to any disclaimer, the term of this patent is extended or adjusted under 35 U.S.C. 154(b) by 0 days.

(21) Appl. No.: 13/502,617

(22) PCT Filed: Oct. 22, 2010

(86) PCT No.: PCT/NO2010/000376

§ 371 (c)(1),
(2), (4) Date: Jul. 3, 2012

(87) PCT Pub. No.: WO2011/049467

PCT Pub. Date: Apr. 28, 2011

(65) Prior Publication Data

US 2012/0261195 A1 Oct. 18, 2012

(30) Foreign Application Priority Data

Oct. 23, 2009 (NO) ..... 20093207

(51) Int. Cl.
*E21B 19/00* (2006.01)

(52) U.S. Cl.
USPC ..... 175/85; 175/52; 166/77.51; 166/85.1

(58) Field of Classification Search
USPC ..... 175/85, 52, 220; 414/22.63, 22.65, 414/22.68, 22.66; 166/77.51, 85.1
See application file for complete search history.

(56) References Cited

U.S. PATENT DOCUMENTS

| | | | | |
|---|---|---|---|---|
| 4,077,525 | A * | 3/1978 | Callegari et al. | 414/22.63 |
| 4,455,116 | A * | 6/1984 | Lindstedt et al. | 414/22.66 |
| 6,113,334 | A | 9/2000 | Riva | |
| 6,212,976 | B1 * | 4/2001 | Stogner | 81/57.34 |
| 6,601,649 | B2 * | 8/2003 | Beato et al. | 166/352 |
| 6,715,569 | B1 | 4/2004 | Rogers | |
| 7,341,109 | B1 * | 3/2008 | McDowell | 166/379 |
| 7,841,415 | B2 * | 11/2010 | Winter | 166/382 |
| 2005/0126827 | A1 | 6/2005 | Berry | |
| 2009/0196712 | A1 * | 8/2009 | Mortensen et al. | 414/22.68 |

FOREIGN PATENT DOCUMENTS

WO 2008/034262 A1 3/2008

OTHER PUBLICATIONS

International Search Report for parent application PCT/NO2010/000376, having a mailing date of Feb. 3, 2011.
Written Opinion for parent application PCT/NO2010/000376, having a mailing date of Feb. 3, 2011.

(Continued)

*Primary Examiner* — William P Neuder
*Assistant Examiner* — Robert E Fuller
(74) *Attorney, Agent, or Firm* — Andrus Intellectual Property Law, LLP

(57) ABSTRACT

A device is for vertical tool guiding for a drill floor. On the drill floor is arranged at least one rig. Each rig is arranged on a rig foundation supported on the drill floor rotatably about a first, vertical axis (A) and arranged to be able to displace a tool in a horizontal working sector ($S_a$, $S_b$, $S_c$) that in a vertical projection at least touches or cuts through the central axis (C) in a through drill floor opening. Each rig is provided with a vertical guide track.

9 Claims, 3 Drawing Sheets

(56) References Cited

OTHER PUBLICATIONS

Applicant's Response dated Jul. 11, 2011 to Written Opinion of Feb. 3, 2011 for parent application PCT/NO2010/000376.

International Preliminary Report for parent application PCT/NO2010/000376, having a completion date of Sep. 14, 2011.

* cited by examiner

TOOL GUIDE DEVICE FOR A DRILL FLOOR

CROSS-REFERENCE TO RELATED APPLICATIONS

This application is the U.S. national stage application of International Application No. PCT/NO2010/000376, filed Oct. 22, 2010, which International application was published on Apr. 28, 2011 as International Publication No. WO 2011/049467 A1 in the English language and which application is incorporated herein by reference. The International application claims priority of Norwegian Patent Application No. 20093207, filed Oct. 23, 2009, which application is incorporated herein by reference.

BACKGROUND

There is described a device for vertical tool guiding for a drill floor, more particularly in that there at the drill floor is arranged at least one rig, as the rig/rigs are each arranged on a rig foundation supported on the drill floor rotatably about a first, vertical axis and arranged to be able to displace a tool in a horizontal working sector which in a vertical projection at least touches or cuts through the central axis in a through rig floor opening, and each rig is provided with a vertical tool guide track.

During work in wells for exploitation of hydrocarbons from a surface installation there is often the need to alternate between several different remedies arranged on or above a drill floor. Particularly concerning tools to carry out vertical movements along or close to the well or its casing central axis is there a need for precise vertical movement of the tool and fast displacement away from and in toward said central axis. An example of this is work taking place during building or dismantling of a drill string.

Equipment used during such operations is often hung from lifting works in a derrick or corresponding installations rising above the drill floor. Horizontal translation normally takes place by the hanging equipment being pulled away from the derrick centre, or that the lifting works are displaced, such as on a bridge crane. Load hanging in wires in a lifting works means a risk both to personnel being on the drill floor, and there is always a possibility for a hanging load to swing due to swaying of the derrick, wind influence or the like.

SUMMARY

The object of the invention is to remedy or reduce at least one of the disadvantages of the prior art.

The object is achieved by the features disclosed in the below description and in the subsequent claims.

The invention provides a device for vertical tool guiding for a drill floor where one or more rigs each provided with vertical tool guide tracks such as sliding guides with hydraulic cylinder, screw or toothed rack feeding, rising up from its own foundation arranged on the drill floor, as each foundation is rotatable about a vertical axis. The tool-guiding track is arranged at a distance from the foundation rotation axis. The distances of the rotational axes and tool guiding track from the respective rotation axis is arranged such that a vertical projection of the horizontal movement sector of each tool at least touches a point on the drill floor, for example represented by the centre of a through opening in the drill floor. Each tool may thereby be displaced in the horizontal direction to individual or cooperating grip on a pipe string extending vertically through said drill floor opening, for example in the form of a drill string or a casing string connected with a well.

Due to the rotatable supporting of the rigs on the drill floor the tools may be swung away from said rig floor central axis for vertical displacement past another tool gripping the pipe string for a new grip above or below the other tool. In one embodiment the tool may also be displaced radially relative to the rig vertical rotational axis. In another embodiment the rig may be rotated about a second vertical axis arranged in a distance from the rig foundation rotation axis.

More specifically the invention relates to a device of a vertical tool guide for a drill floor, characterised in that there on the drill floor is arranged at least one rig, as each rig is arranged on a rig foundation supported on the drill floor and rotatable about a first, vertical axis and arranged to be able to displace a tool in a horizontal working sector which in a vertical projection at least touches or is cuts through the central axis in a through drill floor opening, and where each rig is provided with a vertical tool guide track.

On the drill floor there may be arranged at least two rigs, as the horizontal working sector for the tools of each rig at least partly overlaps in a vertical projection or touches the vertical projection of the working sector of the other rig(s). All the tools may thereby independently of each other carry out work on such as a pipe string extending downward in or in the direction of a subterranean well, bore hole or the like.

The tools may be arranged to be able to be moved radially relative to the rotation axis of the rig foundation. The tools thereby have several degrees of freedom and may carry out a wider scope of types of work both outside the central axis of the through drill floor opening and perpendicular to this.

The rig may be arranged on the rig foundation rotatable about a second vertical axis. Thereby is achieved greater flexibility in the manoeuvring of the tools.

The tools may be from the group comprising rotating tools, striking tools, holding tools and fluid pressure generating tools. The invention may thereby be used for a long series of working operation combinations.

BRIEF DESCRIPTION OF THE DRAWINGS

In the following is described an example of a preferred embodiment illustrated in the accompanying drawings, wherein.

DETAILED DESCRIPTION OF THE DRAWINGS

Figure 1:
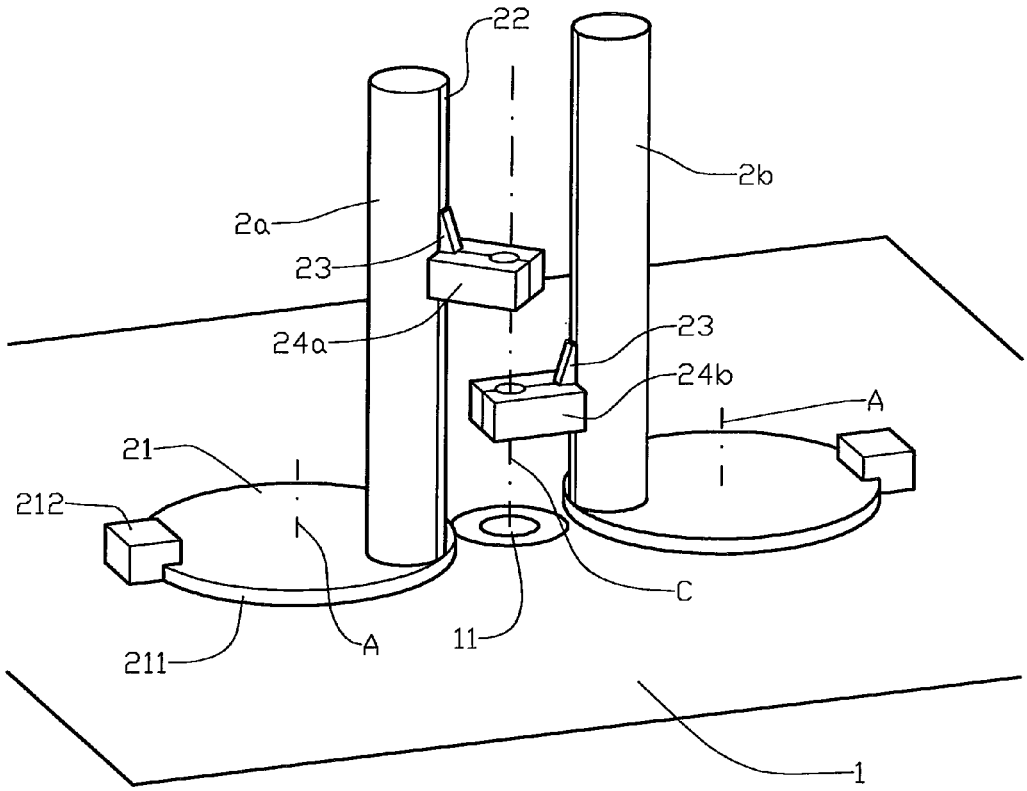
FIG. 1 shows perspectively a principle sketch of a first embodiment comprising two rotatable rigs arranged around a drill floor opening.
Figure 2:
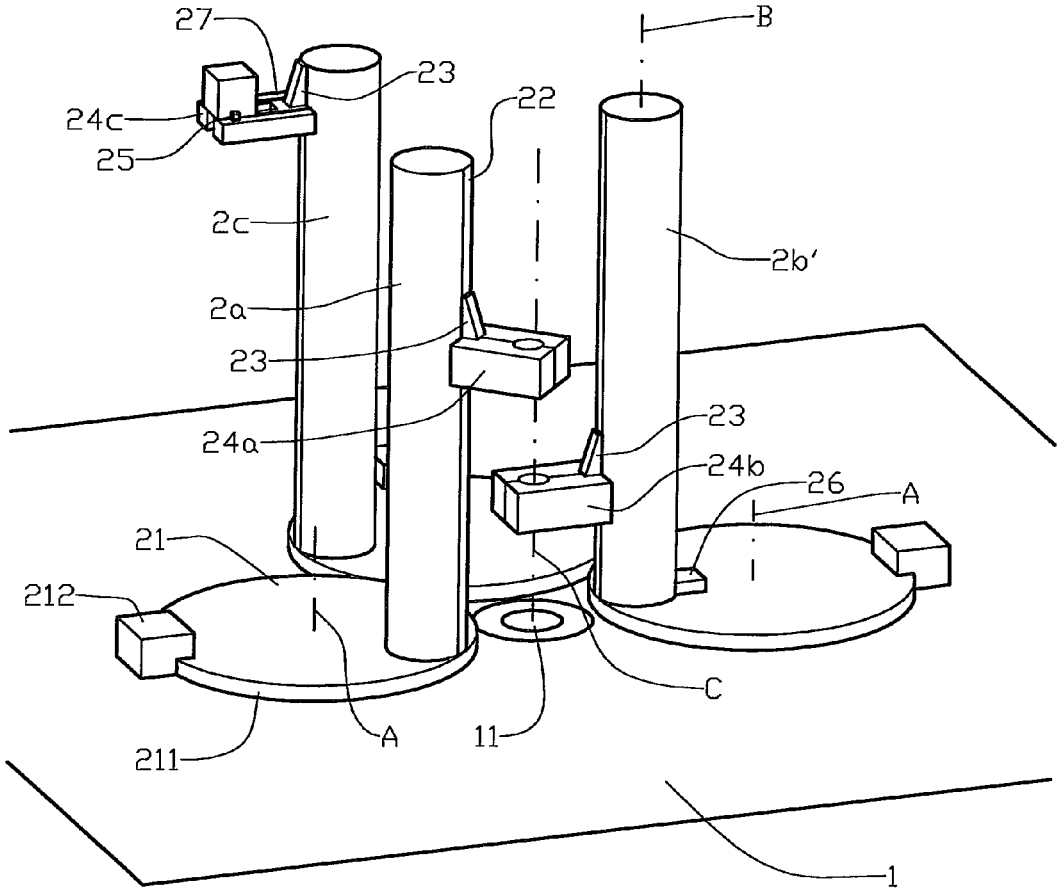
FIG. 2 shows perspectively a principle sketch of a second embodiment comprising three rotatable rigs arranged around a drill floor opening.
Figure 3:
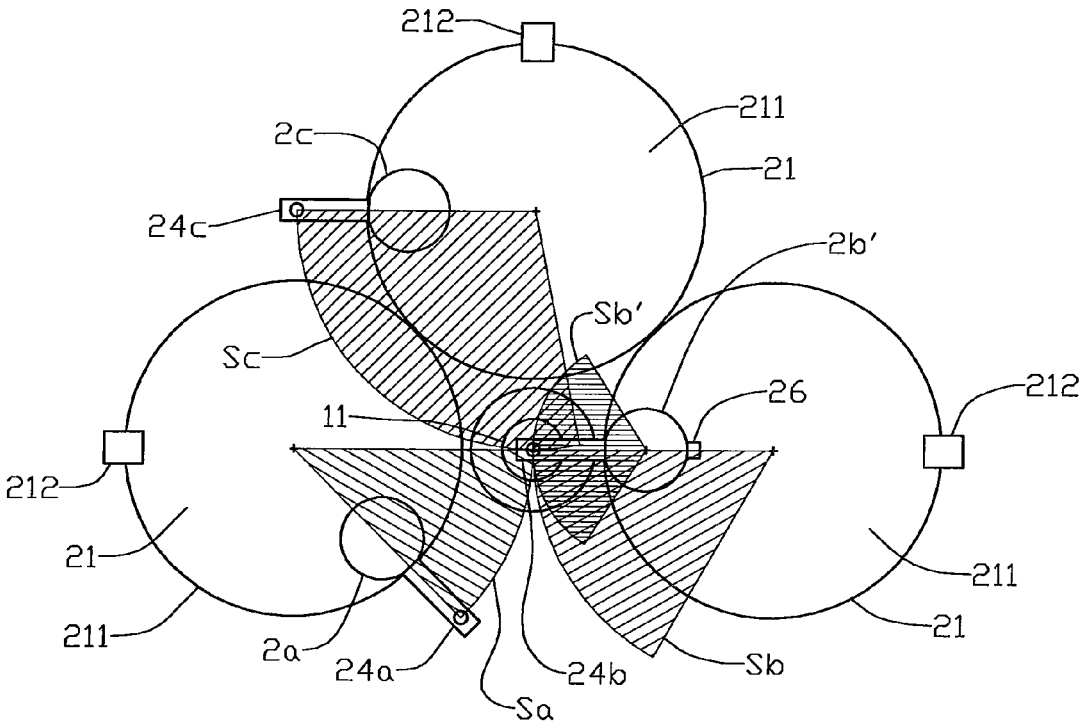
FIG. 3 shows a plan view of the embodiment according to FIG. 2, wherein the working sectors of the tools are indicated.

In the figures the reference numeral 1 indicates a drill floor where is arranged a first and a second rig 2*a*, 2*b* (see FIG. 1), alternatively a first, a second and a third rig 2*a*, 2*b'*, 2*c* (see FIGS. 2 and 3).

The drill floor 1 is in a manner known per se provided with at least one drill floor opening 11 arranged for conveying pipes and tools through, for example to carry out work in a bore hole on a hydrocarbon field. The drill floor opening 11 has a central axis C.

The rigs 2*a*, 2*b*, 2*b'*, 2*c* are each arranged on a rig foundation 21 formed as a turntable 211. The turntable 211 is rotatable about a first, vertical axis A and is provided with a first turning actuator 212 arranged to be able to turn the turntable at least in a sector $S_a$, $S_b$, $S_c$, respectively, see FIG. 3.

The first and second rigs 2*a*, 2*b* according to FIG. 1 and the first and third rig 2*a*, 2*c* according to FIG. 2 are arranged rigidly connected to the turntable 211.

Alternatively the second rig 2*b′* according to FIG. 2 is arranged on the turntable about a second vertical axis B. The rotation of the rig 2*b′* is provided by a second turning actuator 26, as it is arranged to be able to rotate the rig 2*b′* at least in a sector $S_{b'}$ (see FIG. 3).

The rigs 2*a*, 2*b*, 2*b′*, 2*c* are provided with a tool guiding track 22 arranged to receive a tool 24*a*, 24*b*, 24*c* respectively. The tools 24*a*, 24*b*, 24*c* are arranged to be able to be displaced in the longitudinal direction of the tool guiding track 22 for vertical relocation of the tools 24*a*, 24*b*, 24*c* relative to the drill floor 1. Each tool 24*a*, 24*b*, 24*c* is connected to a vertical actuator 23 arranged to relocate the tools 24*a*, 24*b*, 24*c* along the tool guiding track 22 and also to hold the tools 24*a*, 24*b*, 24*c* in a specified position.

The third tool 24*c* (see FIG. 2) is provided with a horizontal actuator 25 arranged to be able to displace the tool 24*c* in a horizontal direction relative to the rig, as in the tool 24*c* is integrated horizontal guide tracks 27.

When work operations are carried out wherein two or more tools 24*a*, 24*b*, 24*c* cooperate, such as in assembling or disassembling a pipe string, one of the tools 24*a*, 24*b*, 24*c* is to be led past one or both of the other two tools 24*a*, 24*b*, 24*c* for a new operation on another portion of said pipe string. The operation of the active tools 24*a*, 24*b*, 24*c* is thereby maintained, and there is provided a high degree of precision and stability for all the tools 24*a*, 24*b*, 24*c* in all positions on their respective rigs 2*a*, 2*b*, 2*b′*, 2*c*. The device according to the invention is particularly actively advantageous when operations shall or should be carried out continuously, such as in assembling or disassembling long pipe strings, for example marine risers connecting a surface installation to a well in deep water, and drill strings used in deep water wells or in horizontal wells.

The invention claimed is:

1. A device for guiding on a drill floor, the device comprising: at least one rig column rising up from a rig foundation that is rotatably supported on a drill floor for rotation about a first, vertical axis, the at least one rig column comprising a vertical tool guiding track arranged at a distance from the first, vertical axis, wherein rotation of the at least one rig column about the vertical axis provides a horizontal working sector of a first tool, a vertical projection of the working sector at least touching or cutting through a central axis in a through drill floor opening, wherein the at least one rig column is arranged on the rig foundation so as to be rotatable about a second, vertical axis that is horizontally spaced apart from the first, vertical axis;

wherein the at least one rig column comprises a second rig column arranged on the drill floor, the second rig column comprising a second tool, wherein the horizontal working sector for the first tool in a vertical projection at least partly overlaps or touches a vertical projection of a horizontal working sector of the second tool; and wherein the first and second tools are movable radially relative to the first vertical axis.

2. The device according to claim 1, wherein the first and second tools are selected from a group consisting of rotating tools, striking tools, holding tools and fluid pressure generating tools.

3. A device for guiding on a drill floor, the device comprising: at least one rig column-rising up from a planar rig foundation that is rotatably supported on a drill floor, the foundation being arranged for rotation about a first, vertical foundation axis, the at least one rig column being radially displaced on the foundation a distance from the first, vertical foundation axis, the at least one rig column being arranged to rotate about its longitudinal, central axis, the at least one rig column further comprising a vertical tool guiding track in which a first tool for operating on a pipe string vertically extending through a drill floor opening is vertically movable along the at least one column at a distance from the first, vertical foundation axis, wherein rotation of the at least one rig column about its longitudinal central axis provides a horizontal working sector of the first tool, a vertical projection of the horizontal working sector at least touching or cutting through the longitudinal central axis in the drill floor opening; and a vertical actuator on the at least one rig column that moves the first tool along the vertical tool guiding track and with respect to the pipe string.

4. The device according to claim 3, wherein the first tool is selected from a group consisting of rotating tools, striking tools, holding tools and fluid pressure generating tools.

5. A device for guiding on a drill floor, the device comprising first and second rig columns rising from first and second planar rig foundations, respectively, the first and second planar rig foundations being arranged for rotation about first and second vertical foundation axes, respectively, the first and second rig columns being radially displaced on the first and second planar rig foundations a distance from the first and second vertical foundation axes, respectively, the first and second rig columns being arranged to rotate about their longitudinal, central axes, the first and second rig columns further each comprising a vertical tool guiding track in which first and second tools, respectively, are vertically movable along the first and second rig columns at a distance from the first and second vertical foundation axes, the first and second tools for operating on a pipe string vertically extending through a drill floor opening; wherein rotation of the first and second rig columns about their central axes respectively provides horizontal working sectors of the first and second tools, a vertical projection of each of the horizontal working sectors of the first and second tools at least partially overlapping each other and at least touching or cutting through a central axis in the drill floor opening, wherein the second tool is arranged to simultaneously cooperatively operate with the first tool on the pipe string; and first and second vertical actuators on the first and second rig columns, wherein the first and second actuators move the first and second tools, respectively, along the first and second rig columns and with respect to the pipe string.

6. The device according to claim 5, wherein at least one of the first and second tools is able to be moved radially relative to the first and second vertical foundation axis, respectively, and further comprising first and second horizontal actuators on the first and second rig columns, respectively, wherein the first and second horizontal actuators horizontally move the first and second tools with respect to the first and second rig columns and the pipe string.

7. The device according to claim 5, wherein the first and second tools are selected from a group consisting of rotating tools, striking tools, holding tools and fluid pressure generating tools.

8. A device for guiding on a drill floor, the device comprising: a first rig column rising up from a first planar rig foundation that is rotatably supported on a drill floor, the first planar rig foundation being rotatable about a first vertical foundation axis, the first rig column being radially displaced on the first planar rig foundation a distance from the first vertical foundation axis, the first rig column being arranged to rotate about its longitudinal, central axis, the first rig column comprising a first vertical tool guiding track and a first tool that is attached to the first rig column and is vertically movable in the first vertical tool guiding track along the first rig column at a distance from the first vertical foundation axis for operating on a stationary pipe string that is vertically extending through a drill floor opening, wherein rotation of the first rig column about its longitudinal central axis provides a first horizontal working sector of the first tool, and wherein a first vertical projection of the first horizontal working sector at least touches or cuts through a central axis of a through drill floor opening; and a first vertical actuator on the first rig column, wherein the first vertical actuator moves the first tool along the vertical tool guiding track and with respect to the stationary pipe string.

9. The device according to claim 8, comprising a second rig column arranged on the drill floor, the second rig column comprising a second vertical tool guiding, track and a second tool that is attached to the second rig column and vertically movable in the second vertical tool guiding track for operating on a stationary pipe string that is vertically extending through a drill floor opening, wherein the second rig column rises up from a second planar rig foundation that is rotatably supported on the drill floor, the second planar rig foundation being rotatable about a second vertical foundation axis, the second rig column being radially displaced on the second planar rig foundation a distance from the second vertical foundation axis, the second rig column being arranged to rotate about its longitudinal, central axis, wherein rotation of the second rig column about its longitudinal central axis provides a second horizontal working sector of the second tool having a second vertical projection that at least touches the central axis of a through drill floor opening; wherein the first tool is configured to cooperate with the second tool; and a second vertical actuator on the first rig column, wherein the second vertical actuator moves the first tool alone the vertical tool guiding track and with respect to the stationary pipe string.

* * * * *